US007182112B2

(12) United States Patent
Meados

(10) Patent No.: US 7,182,112 B2
(45) Date of Patent: Feb. 27, 2007

(54) WOOD PLANING MACHINE WITH AN IMPROVED CUTTER HEAD AND METHOD

(75) Inventor: Thomas A. Meados, Bend, OR (US)

(73) Assignee: DesignTek LLC, Albany, OR (US)

( * ) Notice: Subject to any disclaimer, the term of this patent is extended or adjusted under 35 U.S.C. 154(b) by 147 days.

(21) Appl. No.: 10/869,762

(22) Filed: Jun. 15, 2004

(65) Prior Publication Data

US 2005/0006001 A1 Jan. 13, 2005

Related U.S. Application Data

(60) Provisional application No. 60/517,121, filed on Nov. 3, 2003, provisional application No. 60/483,530, filed on Jun. 27, 2003.

(51) Int. Cl.
*B27C 1/02* (2006.01)
*B27C 1/14* (2006.01)

(52) U.S. Cl. ..... 144/117.1; 144/218; 407/41; 407/49

(58) Field of Classification Search ..... 144/218, 144/220, 221, 230, 227, 229, 172–174, 117.1, 144/114.1; 407/40, 41, 66, 46–49; 241/92, 241/292.1, 293, 294
See application file for complete search history.

(56) References Cited

U.S. PATENT DOCUMENTS 632,618 A 9/1899 Anderson
700,736 A 5/1902 Cadell
793,097 A 6/1905 Rice
872,414 A 12/1907 Hall
934,436 A 9/1909 Gray
943,540 A 12/1909 Harrold
995,040 A 6/1911 Stevens
1,153,910 A 9/1915 Harrold
1,298,737 A 4/1919 Lane et al.
1,524,542 A 1/1925 Divers
1,713,066 A 5/1929 Wolf
1,951,101 A 3/1934 Miller
2,395,287 A * 2/1946 Miller et al. ..... 407/108
3,776,289 A 12/1973 Boboltz (Continued)

OTHER PUBLICATIONS

Brochure, entitled "Key Planer Head", by Key Knife, Inc., Tualatin, Oregon, Presented at Wood Technology and Clinic, Portland, Oregon 2004.

(Continued)

*Primary Examiner*—Lowell A. Larson
*Assistant Examiner*—Shelley Self
(74) *Attorney, Agent, or Firm*—Klarquist Sparkman LLP

(57) ABSTRACT

A cutter head for wood planing machine comprises elongated slots, wedges and blade retainers of a cooperative configuration that allows the blade retainers to be positioned in the slots with the wedges overlying the blade retainers. The wedges may be shifted upwardly and away from a base portion of the associated blade retainer to urge the blade retainer toward a blade to clamp the blade in the slot. Magnets may be used to loosely hold the blade in place for adjustment of blade height or to tighten the blade retaining assembly comprising the associated wedge and blade retainer. In addition, the base of the blade retainer may be retained in the slot by one or more magnets.

25 Claims, 9 Drawing Sheets

U.S. PATENT DOCUMENTS

| | | | | | |
|---|---|---|---|---|---|
| 3,865,164 | A | | 2/1975 | Sybertz | |
| 3,989,077 | A | | 11/1976 | Humbert | |
| 4,470,442 | A | | 9/1984 | Krautzberger et al. | |
| 4,475,425 | A | * | 10/1984 | Punater et al. | 83/699.61 |
| 4,658,875 | A | | 4/1987 | Grabovac | |
| 5,163,490 | A | | 11/1992 | Meis | |
| 5,240,192 | A | * | 8/1993 | Tilby et al. | 241/292.1 |
| 5,329,978 | A | | 7/1994 | Hasegawa | |
| 5,456,300 | A | | 10/1995 | Rosenkranz et al. | |
| 6,523,768 | B2 | | 2/2003 | Recker et al. | |
| 6,896,017 | B2 | * | 5/2005 | Rankin, Sr. | 144/174 |

OTHER PUBLICATIONS

OUTILS bgr TOOLS Planer Head, date unknown, obtained by Applicant in 2006.

BGR 36 Knife Cutterheads, date unknown obtained by Applicant in 2006.

* cited by examiner

WOOD PLANING MACHINE WITH AN IMPROVED CUTTER HEAD AND METHOD

RELATED APPLICATION DATA

This application claims the benefit of U.S. provisional patent application Ser. No. 60/517,121, filed Nov. 3, 2003, entitled, "Wood Planing Machine With An Improved Cutter Head And Method", by Tom Meados, and U.S. provisional patent application No. 60/483,530, filed Jun. 27, 2003, entitled, "Wood Planing Machine With An Improved Cutter Head And Method", by Thomas A. Meados, which are hereby incorporated by reference.

BACKGROUND

Wood planing machines or joiners have cutter heads for planing wood during finishing of the wood. Commonly, these planing machines have a plurality of rotary cutting heads, such as for planing the top, bottom and side surfaces of lumber. The cutter heads have knife blades releasably mounted thereto by a mounting mechanism. The present invention relates to improved cutter heads and improved mounting systems for mounting blades to cutter heads as well as to planing machines with such improvements and to related methods.

The present invention is not limited to any specific embodiment disclosed herein nor is it limited to embodiments which accomplish one or more advantages set forth herein. Instead, the invention is directed toward new and unobvious features and method acts, both alone and in combinations and sub-combinations with one another.

The cutting heads are typically cylindrical and may include projecting shafts for engagement by motors which drive the cutting heads in rotation to accomplish the cutting or planing task.

FIG. 1 schematically illustrates one form of a known rotary cutter head for use in a planer. The cutter head of FIG. 1 comprises an elongated cylindrical body 20 having a plurality of inwardly directed elongated slots, some of which are numbered as 21. A respective cutter blade is included in each of the slots. Several of these cutter blades are indicated at 22 in FIG. 1. The cutter head is rotated in the direction of arrow 26. The respective cutter blades shave wood chips from lumber (e.g., lumber 32 supported by a supporting surface 34) as the lumber is advanced in the direction of arrow 36 through the planer. Upper and lower cutter heads may oppose one another so that two opposing surfaces of the lumber are planed at the same time, although this is not required. The knife blades 22 each have a tapered surface 40 which terminate in a knife edge 42 which planes the lumber. The knife edges 42 are desirably positioned at a common radius R1 from the center 25 of the cutter body 20. Motors drive the cutter bodies at typically a very high speed, such as 3600 RPM, although this speed can be varied. The slots 21 are sized to each receive a blade retainer, such as a gib or clamping piece, some of which are indicated at 50 in FIG. 1. The illustrated gibs 50 each have a flat surface which bears against the adjacent side surface of the knife blade with the gib being positioned at the leading side of its associated knife blade relative to the direction of rotation. A concave surface may be formed at the outer exposed edge of the gib to assist in directing woodchips away from the cutter head during the planing operation. Some of these concave surfaces are indicated at 52 in FIG. 1.

The cutter body 20 is provided with a plurality of tapped counter bore holes, some of which are indicated at 54 in FIG. 1. A plurality of these bores 54 is associated with and positioned along the length of each blade. These holes each receive a set screw (some of which are indicated at 55 in FIG. 1) which applies a clamping force directly against the associated gib to urge the gib against the adjoining surface of the blade to clamp the blade in the slot at its desired position. In an exemplary prior art cutter head, the slots, blades and gibs are fifteen inches long. In addition, a number of set screw receiving holes (eight to ten, for example) are positioned at spaced apart locations in the cutter body along the length of each slot to receive set screws to bear against the gib when the gib and blade is positioned in the associated slot. Thus, for a 15" wide cutter body, for example, eight to ten pressure application points are provided (one for each set screw) to clamp each gib and blade in the associated slot when the respective set screws are tightened within the bores associated with the gib.

As can be seen in FIG. 1, which illustrates a 14.25 inch diameter cutter head (2×R1=14.25 inches), 20 knives are positioned about the periphery of the cutter head with the knives being oriented at a 25 degree cutting angle. The positioning of the set screw receiving bores due to this construction limits the number of blades that can be included in such a cutter head because the bores occupy a significant portion of the space between the blades at the surface of the cutter head.

During normal use of a cutter head, the knife steel eventually becomes dull. It is common practice to resharpen the blades at this point using a method known as jointing. In one common approach, a sharpening stone is held perpendicular to the centerline of the cutter head with the machine running (e.g., the cutter head rotating at 3600 RPM) to resharpen the blades. Resharpening can be accomplished a number of times (for example, two to four times) until the surface at the point of the knife blade becomes too wide (also known as the "heel") for effective cutting and it begins to beat the wood and create raised grain. When this occurs, the knife blades are removed and replaced with new or reground blades with the taper 40 and sharp tip 42. The removed knives may be reground numerous times until their width (the distance from the base of the blade to the tip) is reduced to a point where they are no longer considered safe. For example, a new knife may have a width of two inches and may be reground until the width is about 1 1/16 inches as an exemplary minimum. When this happens, the knife steel is discarded.

When the new blades are installed, they need to be set at the proper height so that the tips of the knives all lie on the same periphery, e.g., at R1 in FIG. 1. A common approach is to loosely mount the knives in the cutter head body and then to use either a hammer gauge or a roller gauge to set the knives to have tips at the same periphery.

One approach for setting blade height uses a hammer gauge. A hammer gauge is a hand held device consisting of a pair of contoured surfaces which make contact with the cutter head body on either side of a knife. A slot between the contoured surfaces fits over the sharpened edge of the knife with a recess to protect the knife edge from damage. In use, the knives are loosely set at a generous distance above (radially outwardly beyond) their intended final position. The slot of the hammer gauge is then placed over the knife at one end of its length and a hammer is used to lightly drive the hammer gauge and knife down into its slot in the cutter head body until the contoured portions of the gauge make contact with the cutter body. This is repeated at the other end of the knife. After the height of all of the knives have been set, the set screws are progressively tightened, alternating tightening between set screws for knives at 180 degrees apart about the head so as to reduce stresses on the cutter head body.

Another approach for setting blade height uses a roller gauge. A roller gauge is a fixture which is either permanently or temporarily attached to the planer machine in such a way as to accomplish the same result as the hammer gauge. In one form, a roller gauge consists of two side plates, each with a pivot point at one end and a bored hole at the other. The bored holes accept a shaft running between the side plates. The length of the shaft is sized to be compatible with the width of the cutter head involved. Two discs are mounted on the shaft. Each disc has a flat surface which has been machined from its periphery. The discs are free to rotate on the shaft. The fixture is pivoted so as to bring the discs to a specific distance from the cutter head axis. This distance is adjustable and will ultimately be the preferred distance for the edges of all the knives in the head. In use, the knives are again loosely set at a generous distance above their intended final position. This initial setting is done with the discs on the fixture set so that the flat portion of the disc is nearest the knife edges, but with clearance between the flat and the knife edge. The discs are then turned on their shaft so that the disc radius is closest to the knife edges and will create an interference condition between the two. The cutter head body is then gently rotated on its axis and as each knife edge makes contact with the two discs on the fixture, the knife is forced down into its respective slot in the cutter head body. In this manner, the edges of all the knives are set to the same radius on the head. The final procedure for tightening the knives into the head may be the same as described above for the hammer gauge process.

With the above approach, replacement of the knives is time consuming. This results in considerable downtime while the knives are being replaced. In addition, the point contact provided by the set screws against the gib requires a significant number of screws per length of gib to provide a given knife holding force. An increase in the number of screws that is required means that more screws need to be loosened and then re-tightened during knife blade replacement.

SUMMARY

In accordance with one embodiment, a wood planing apparatus comprises an elongated cutter head body rotatable about an axis of rotation. The cutter head body includes an exterior surface and comprises plural elongated blade retaining slots desirably extending in a lengthwise direction along the cutter head body. Each slot comprises a first wall surface extending inwardly into the cutter head body from the exterior surface of the cutter head body. The first wall surface provides backup or support to a blade inserted into the slot. A slot base surface is spaced from the exterior surface and desirably positioned at the base of the slot. A second wall surface, spaced from the first wall surface, comprises a wedge retaining portion including a slot wedging surface. The slot wedging surface comprises a portion of the second wall surface and desirably at least partially overhangs the slot base surface.

A plurality of blade retainers are provided, desirably one or more for each slot. Each blade retainer comprises a base portion for positioning adjacent to the slot base surface of a respective associated slot into which the blade retainer is inserted. Each blade retainer also desirably comprises a blade retention portion extending upwardly from the base portion. The blade retention portion comprises a blade retention surface positioned adjacent to and spaced from the first wall surface of the associated slot. Thus, an elongated blade may be placed between the blade retention surface and first wall surface. The blade retention portion of each blade retainer in this embodiment desirably comprises a retention member wedging surface that also partially overhangs the slot base surface of the associated slot. Thus, the slot wedging surface and retention member wedging surface desirably define respective planes that converge toward one another.

The embodiment desirably comprises a plurality of wedges, one or more for each slot, and each wedge being associated with at least one blade retainer positioned in the slot. Each wedge desirably comprises a first wedging surface portion positioned for selected coupling to the slot wedging surface of the associated slot. Each wedge desirably overhangs the base portion of the associated blade retainer. Each wedge desirably also comprises a second wedging surface portion positioned for selected coupling to the retention member wedging surface of the associated blade retainer.

A mechanism is provided for selectively urging the wedge away from the base of the slot, and desirably away from the base portion of the associated blade retainer, and toward the slot wedging surface and retention member wedging surface. As the first and second wedging surfaces are coupled to and urged toward the respective slot wedging surface and retention member wedging surface, the blade retention surface of the associated blade retainer applies a clamping force to a blade positioned in the slot. When the wedge is in a locking position, the blade is securely held in place between the first wall surface of the slot and the blade retention surface of the associated blade retainer.

The wedge and blade retainer, associated with each blade comprises a form of blade retention assembly that applies a clamping force to an associated blade to retain the blade in the associated slot. Desirably, each blade leads the associated blade retention assembly in the direction of rotation of the cutter head. In other words, the blade retention assembly desirably in this embodiment is positioned behind or lags the cutting edge of the knife blade. This construction, among other benefits, facilitates the inclusion of a greater number of blades in a cutter head of a given cutting diameter.

Each slot of the cutter head may comprise a blade receiving pocket defined in part by the slot base surface and positioned adjacent to the first wall surface. The pocket, if provided, permits the use of taller blades as there is room for the bottom edge of the blade to be inserted into the pocket with the cutting edge of the knife positioned at the appropriate radius from the longitudinal axis of the cutter head body. The slot desirably also comprises a stop projecting from the slot base surface and desirably spaced from the first wall surface. The stop is desirably positioned adjacent to the blade receiving pocket. The base portion of each blade retainer may comprise a stop engaging portion positioned to engage the stop of the associated slot to limit the extent of movement of the blade retainer toward the first wall surface of the associated slot.

In a specific illustrated form, the wedges may be hexagonal in cross-section and each blade retainer may be generally L-shaped (or equivalently mirror image L-shaped) in cross-section. The distal end of the blade retention portion of each blade retainer is desirably of an increased thickness. A thinned region may also be provided in each blade retainer at the location where the blade retention portion extends from the blade base portion. This facilitates some flexing of the blade retention portion relative to the base portion as the wedge is moved to a locking position.

Desirably, the first and second wedging surface portions of each wedge define an included angle that is from about 20 to 30 degrees with 20 degrees being a particularly desirable angle. In addition, desirably the first and second wedging surfaces are planar. In addition, in a particularly desirable form, the slot wedging surface is planar and is at an angle that matches, is the same as, the angle of the first wedging surface of the associated wedge. In addition, desirably the retention member wedging surface is planar and at an angle that matches the angle of the second wedging surface portion of the associated wedge. These wedging surfaces may comprise less than all of, and desirably a major position of, a surface of the component that includes the surface. Although the first and second wedging surface portions of the wedge may be coupled to the respective slot wedging surface and retention member wedging surface through other components, desirably these surfaces directly abut one another when the wedge is in the locking position. In addition, desirably one major surface of the blade abuts the first wall surface and the opposed major surface of the blade abuts the blade retention surface when the wedge is in the locking position.

In accordance with an embodiment, an elongated insert may be recessed into the surface of the cutter head body at a location that leads the blade in the direction of rotation of the cutter head body. The insert may have a chip deflecting surface which is arcuate in cross-section and elongated in that it extends lengthwise along the insert with the chip deflecting surface being positioned adjacent to the leading edge of the blade.

In one specific form, a selective force applicator is coupled to the wedge and operable to selectively apply a locking force to urge the wedge toward the locking position. In one specific example, each wedge comprises at least one threaded wedge aperture extending through the wedge and toward the base portion of the associated blade retainer. Desirably, two such threaded apertures are provided. A threaded member is provided for and threadedly received within each such aperture. Rotation of the threaded member in one direction urges the wedge toward a locking position. Rotation of the threaded member in the opposite direction relieves the applied clamping force to permit removal of the blade from the associated slot when the wedge is not in a locking position.

In one specific desirable form, the blade retainer comprises at least one first magnet positioned in the base portion and oriented to provide a magnetic attraction force toward the slot base surface of the cutter head body. Desirably, the cutter head body is comprised of steel or other ferrous material to which a magnet is attracted. The at least one first magnet assists in retaining the blade retainer within the associated slot, such as when the clamping force is relieved. Also, the blade retainer desirably comprises at least one second magnet in the blade retention portion thereof and oriented to provide a magnetic attraction force toward the first wall surface of the associated slot and thus toward a blade inserted between the blade retention surface and first wall surface of the associated slot. This at least one second magnet thereby assists in holding the blade in place, such as while a wedge is being moved toward a locking position.

In a specific illustrated form, there may be plural elongated wedges and plural elongated blade retainers positioned within each slot. Desirably, these slots extend along the entire length of the cutter head body and each have a longitudinal axis which is parallel to the longitudinal axis of the cutter head body.

Wedges, blade retainers (also sometimes referred to as gibs), and cutter heads having features as described herein are also within the scope of this disclosure.

These and other features of a wood planing apparatus will become apparent from the description below.

DETAILED DESCRIPTION

Disclosed below are representative embodiments of a wood planing apparatus and components thereof. Related methods are also apparent from the following description. The disclosed methods and apparatus should not be construed as limiting in any way. The present invention is directed toward novel and non-obvious features and aspects of the various disclosed embodiments, alone and in various combinations and sub-combinations with one another as well as to variations of such features. Moreover, the methods and apparatus are not limited to any specific aspect or feature or combinations thereof, nor do the disclosed methods and apparatus require that any one or more specific advantages be present or problems be solved.

For purposes of this disclosure, the word "including" has the same broad meaning as the word "comprising". In addition, words such as "a" and "an", unless otherwise indicated to the contrary, include the plural as well as the singular. Thus, for example, the requirement of "a feature" is satisfied where one or more of these features are present. In addition, the term "or" includes the conjunctive, the disjunctive and both (a or b thus includes either a or b, as well as a and b) unless otherwise indicated. In addition, terms such as "coupled" or "coupling" with respect to two or more components indicate that such components may be directly coupled together (e.g., abutting one another) or indirectly coupled together through one or more other components (e.g., spacers and the like). Terms such as "abutting or directly contacting" means that the components are touching one another.

Figure 2:
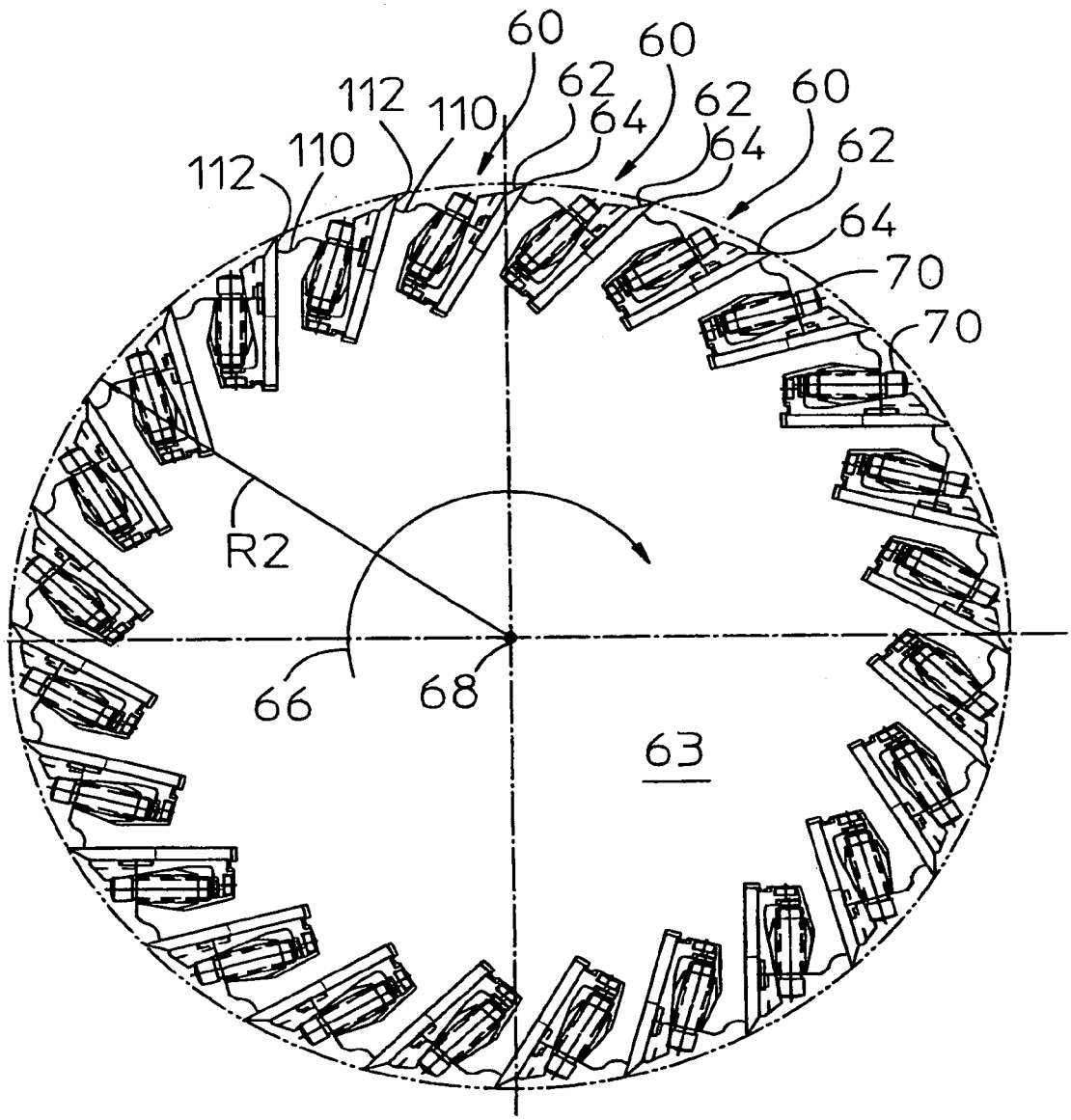
FIG. 2 is a side elevational view of one embodiment of a wood planing apparatus with an exemplary form of cutter head and blade retention assemblies.

FIG. 2 illustrates one embodiment of a new form of cutter head. As is apparent from FIG. 2, the blade coupling assemblies (such as one coupling assembly per blade with several exemplary assemblies being indicated at 60 in FIG. 2) are utilized to retain the respective blades 62 in position on body 63 of a cutter head for performing their cutting operation. These coupling assemblies 60 are desirably located at the trailing edge side of the blade relative to the direction of motion 66. The blade tips 64 in the FIG. 2 embodiment are at a radius R2 which may be the same as radius R1 for the same size cutter head.

Figure 3:
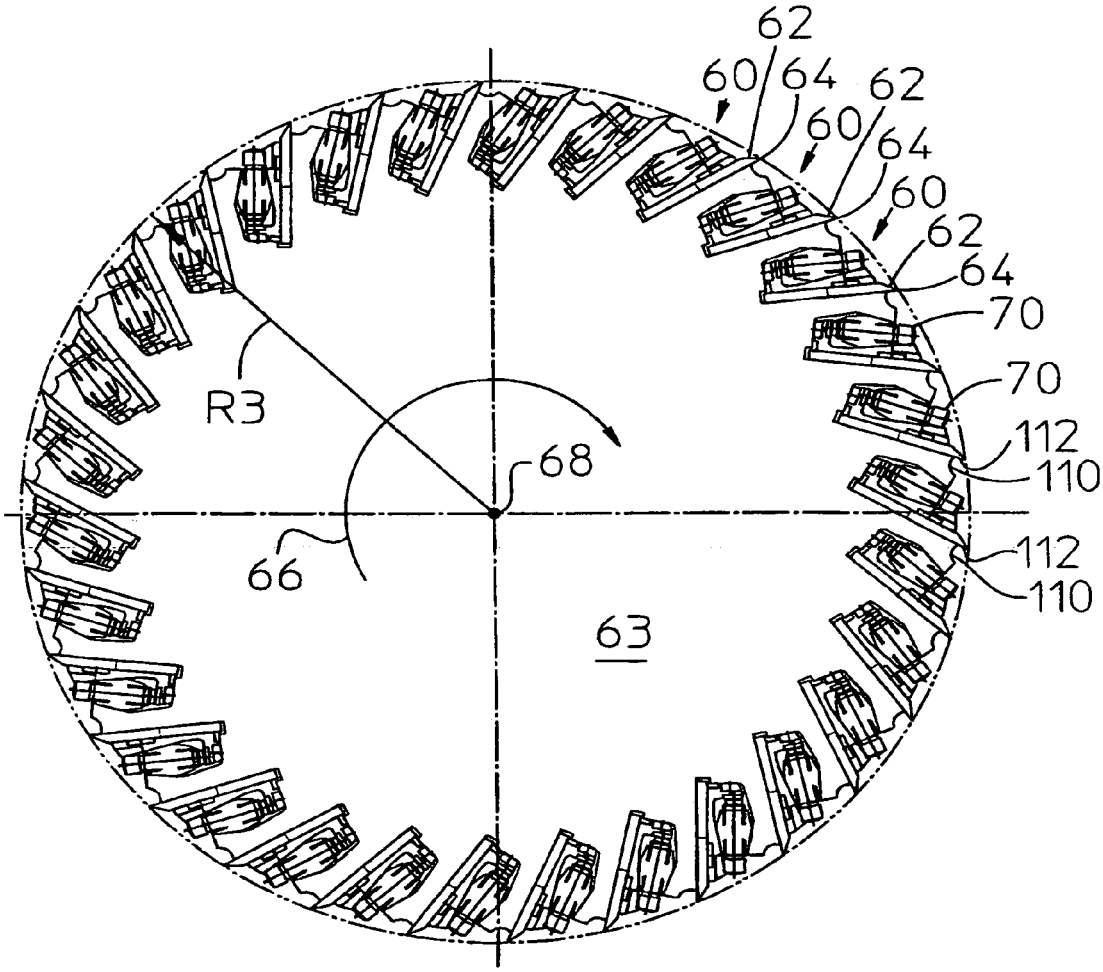
FIG. 3 is an alternative embodiment like that shown in FIG. 2 but with more blades on the cutter head body than shown in FIG. 2.

The embodiment of FIG. 2 depicts a 12 3/16 inch diameter cutter head (2×R2=12.1875 inches) with 24 knives at a 27.5 degree cutting angle. The embodiment of FIG. 3 depicts a 14.25 inch cutter head (2×R3=14.25 inches) with 30 knives at a 25 degree cutting angle. The components of FIG. 3 have been given the same numbers as the corresponding components of FIG. 2, but R2 has been replaced by R3 in FIG. 3. Although less desirable, the coupling assemblies may be alternatively positioned at the leading edge side of each associated blade.

The blade coupling assemblies 60 each desirably comprise a wedge mechanism for releasably wedging a retainer such as a gib against or coupled to the trailing surface of the blade 62. The blades 62 rotate in the direction of arrow 66 in FIG. 2. The exemplary blade retaining mechanism 60 of the embodiments of FIGS. 2 and 3 are discussed below in connection with FIGS. 4, 5 and 6. With the construction shown in FIGS. 2 and 3, respective fasteners, such as set screws are provided for retaining the associated respective blade(s) in the associated slot. Some of these fasteners are numbered as 70 in FIGS. 2 and 3. These fasteners may have their longitudinal axes substantially parallel to the plane of the associated blade. For a given diameter of cutter head, and with the blade retention assemblies at the trailing side of the blade, more blades can be accommodated because less room is required for the blade clamping assembly than in the embodiment of FIG. 1. Thus, for example, in FIG. 3 for a 14.25 inch diameter cutter head with a 25 degree cutting angle for the blades, an additional ten knives are accommodated in the embodiment of FIG. 3 (as compared to FIG. 1) bringing the total number of knives in FIG. 3 to 30.

As explained more fully below, in the embodiments of FIGS. 2 and 3, one need not bore and tap the body to receive set screws as the clamping assembly, including set screws or other blade retention mechanisms, may be slidably positioned within an associated slot in the cutter body 63 without the set screw or fastener being secured to the cutter body. Less desirably, one could interconnect the blade retaining mechanism to the cutter head body, such as at a few locations using screws or other fasteners.

Figure 1:
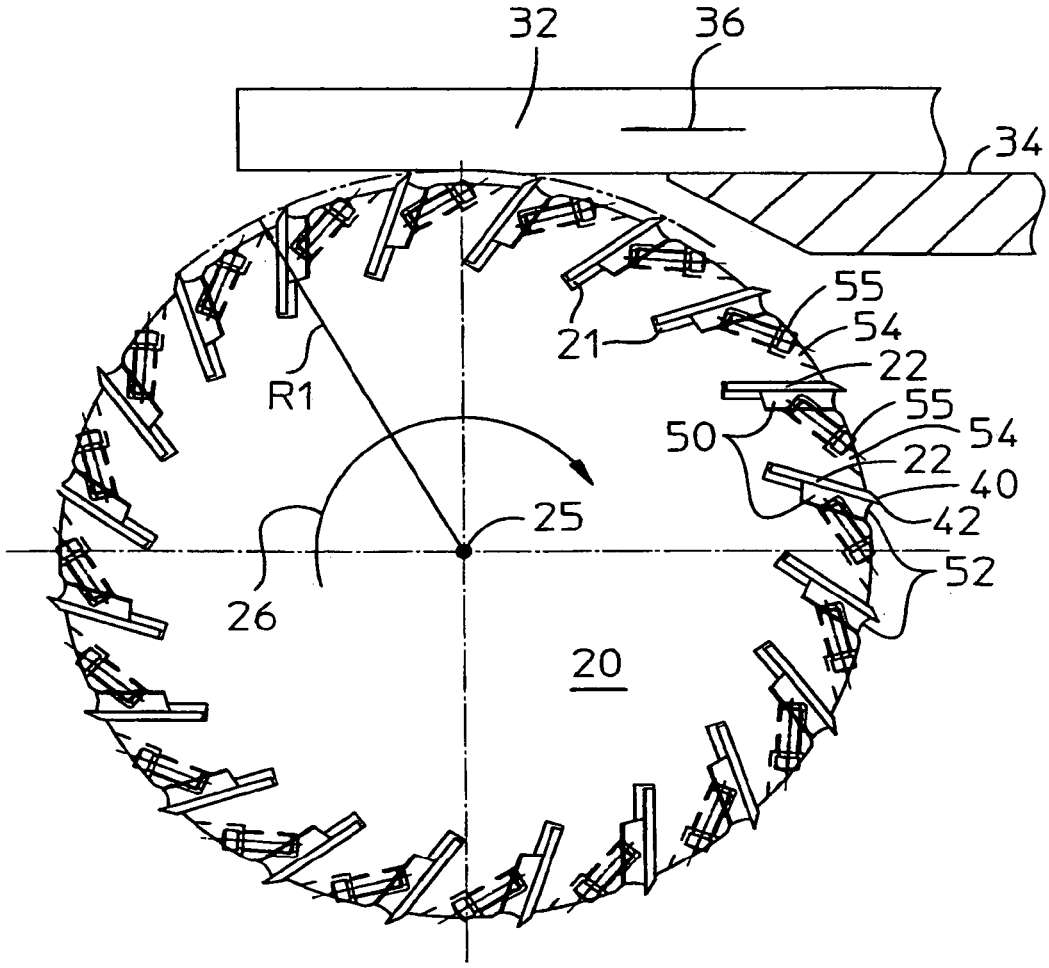
FIG. 1 PRIOR ART
FIG. 1 is a side elevational view of an exemplary prior art form of wood planing machine with a cutter head.

In FIGS. 2 and 3, the longitudinal axes of the fasteners 70 more closely extend in the radially inward direction toward the center of the cutter body 63 than in the FIG. 1 design. Motor coupling shafts and the like, which are typically included in cutter bodies, or secured thereto, are not shown in FIGS. 2 and 3 for convenience.

Figure 7:
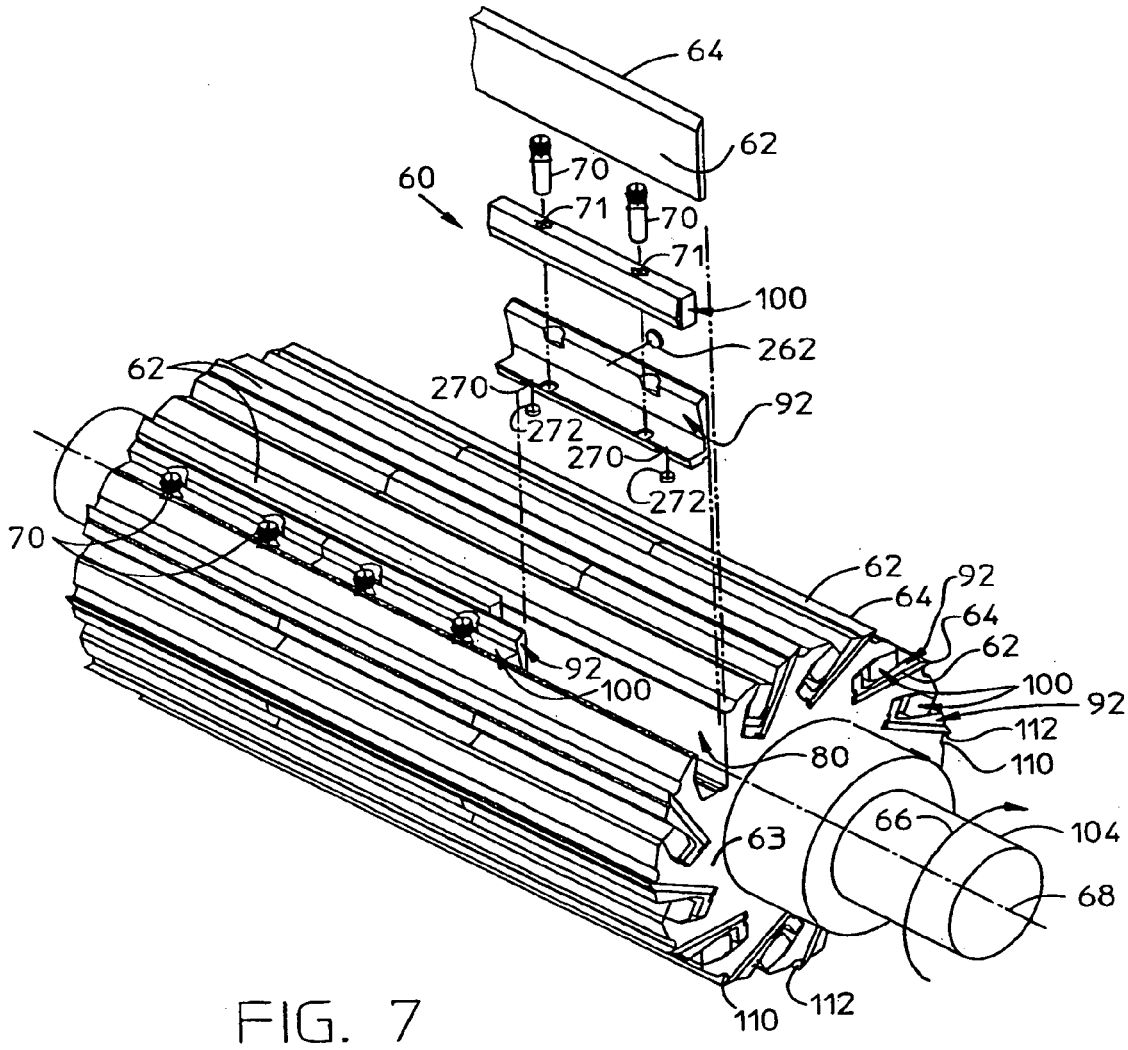
FIG. 7 is a partially exploded view of one form of a cutter head assembly in accordance with an embodiment.
Figure 8:
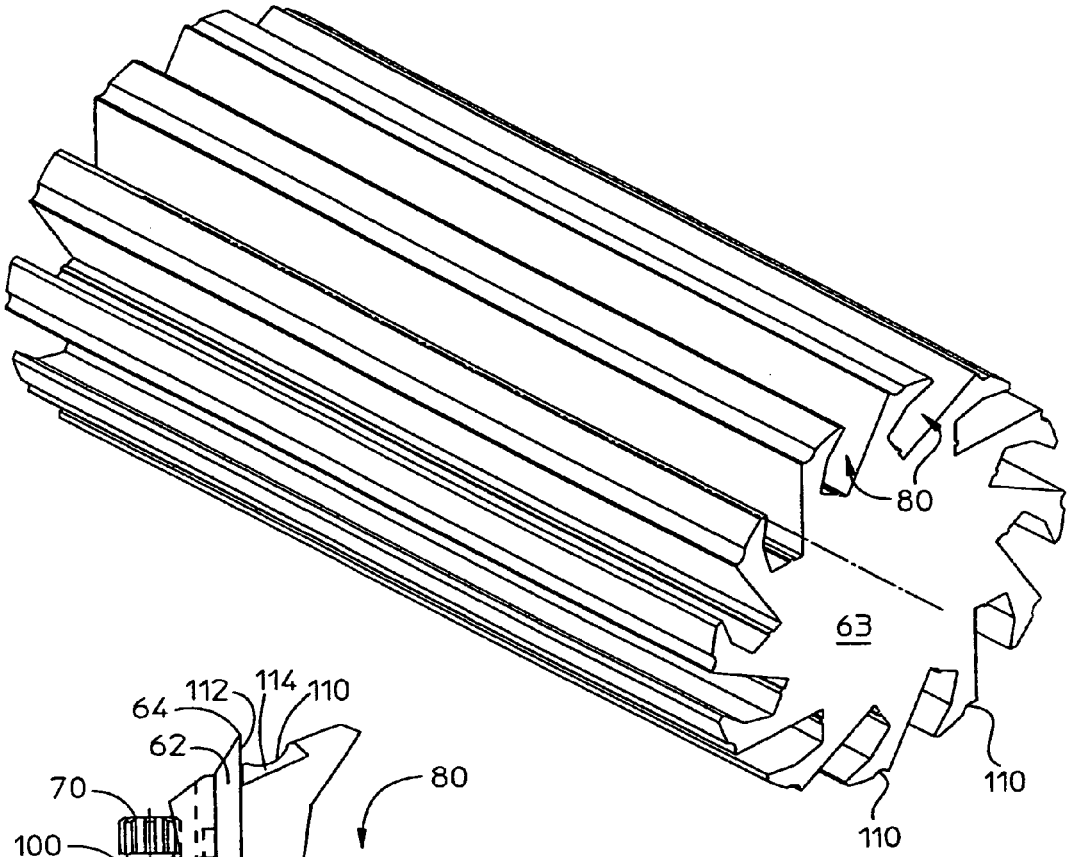
FIG. 8 is an isometric view of a form of cutter head.
Figure 11:
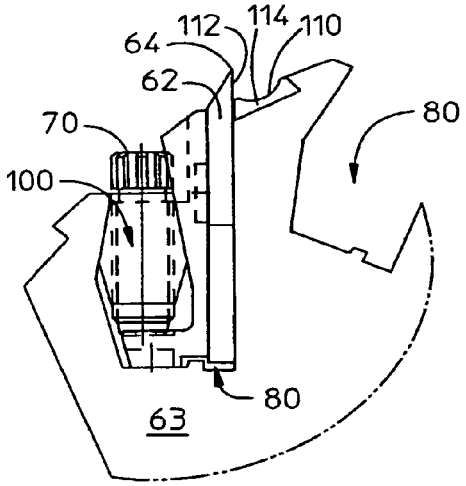
FIG. 11 is a cross-sectional view of a form of cutter head with an abrasion resistant insert.

An exemplary embodiment of the rotary cutter head for use in a planer is shown in FIG. 7. The cutter head of FIG. 7 (see also FIG. 8) comprises a cylindrical body 63 that is elongated and that incorporates a plurality of inwardly directed grooves or slots, some of which are numbered as 80 in FIG. 7. Slots 80 are desirably elongated and most desirably extend along substantially all, or entirely along, the length of the cutter head body 63. Less desirably, the slots may each be comprised of plural discrete slot sections that may be axially aligned with the longitudinal axis of the cutter body 63 or skewed relative thereto. Cutter blades 62 are retained in the slots. Several of these cutter blades are indicated at 62 in FIG. 7. The cutter head is rotated in the direction of arrow 66. As previously described, the respective cutter blades shave wood chips from lumber, e.g., supported by a supporting surface, as the lumber is advanced through the planer. Upper and lower cutter heads may oppose one another so that two opposing surfaces of the lumber are planed at the same time, although this is not required. Opposing side cutter heads may also be used if desired. The knife blades 62 each have a tapered surface that terminates in a knife edge 64 that planes the lumber. The knife edges 64 are desirably positioned at a common radius (e.g., R2 or R3 in FIGS. 2 and 3) from the center 68 of the cutter body 63. The center 68 is positioned along the longitudinal axis of the cutter body. As previously described, motors, not shown, drive the cutter body at typically a very high speed, such as 3600 rpm, although this speed can be varied.

The respective slots 80 are sized and shaped to each receive a blade retainer, such as comprised of a gib 92 (some of which are numbered in FIG. 7), and a wedge mechanism for releasably retaining the knife blade in place. In FIG. 7, the exemplary wedge mechanism comprises a clamping wedge (some of which are indicated by the number 100 in FIG. 7). Gib 92 and wedge 100 may be of plural piece construction, but are desirably each of a single piece of material such as steel or other durable materials. Gib 92 and wedge 100 comprise a desirable form of blade coupling assembly 60. Each assembly 60 retains a respective blade within an associated slot in position for performing a cutting operation. In the embodiment of FIG. 7, the blade coupling assemblies 60 are each located at the trailing edge side of the associated blade relative to the direction of motion 66. The blade tips 64 in the FIG. 7 embodiment are at a common radius (e.g., R2 or R3 as in FIGS. 2 and 3). The radius is variable, for example for differently dimensioned cutter heads. The cutting angle is also variable and may be dependant on the material species being processed and the desired material surface finish. The cutting angle refers to the angle formed between the face of a knife (e.g., surface 112 in FIG. 4) and another line drawn from the tip of the knife (e.g., tip 64 in FIG. 4) through the center of the cutter head. This cutting angle generally varies from 5 degrees to 30 degrees. In the exemplary construction shown in FIG. 7, respective fasteners, such as threaded members with set screws being a specific example (some being numbered as 70 in FIG. 7), may be used to selectively urge the clamping wedge 100 against a wedging surface of the associated gib 92 and a wedging surface of the associated slot 80 to wedge or clamp the blade at a desired elevation within the slot. Less desirably, intermediate components may be positioned between the slot and/or the gib and the wedge. Alternative forms of mechanisms may be used to urge the wedge against these wedging surfaces to thereby selectively apply the clamping force to the blade.

Desirably as shown in FIG. 7, the gibs 92 and clamping members such as wedges 100 are elongated so as to extend along the length of the respective slots 80. These components may be multi-piece components or of a single piece construction. The gibs 92 and wedges 100 may extend along a major portion and in one alternative desirably along substantially the entire length of their associated slots. Alternatively, two or three gib and wedge assemblies may be positioned in each slot. Exemplary gib lengths and wedge lengths are 5 and 7.5 inches. These components need not be of the same length, although this is desirable. The fasteners 70 may be spaced along the length of the wedges 100, such as the two set screws 70 for each wedge 100 in FIG. 7. Desirably, the fasteners are simply threaded into (and through) respective threaded apertures of the wedge 100 so that there is no need to drill or tap the body 63 for the fasteners. Motor coupling shafts and the like, are typically included in cutter bodies or are secured thereto. A schematic representation of a drive shaft is indicated by the number 104 in FIG. 7.

The gibs of known conventional knife holding systems that are positioned at the leading edge side of cutter blades are known to have a concave surface, or sometimes an angled surface, at their top which serves to enhance wood chip formation and to direct wood chips away from the periphery of a cutter head (see surfaces 52 in FIG. 1). This is commonly referred to as the gib face or gullet space. Wood chips are moved at high velocities and can be very abrasive over time. The gib is normally hardened steel which will resist wear from these wood chips. Gibs do wear down eventually and are typically replaced by replacement gibs. The gibs of the prior art thus somewhat protect the integrity of the much more expensive cutter head body ahead of the blade.

Since the embodiments of FIGS. 2, 3 and 7 place the gib holding system on the opposite side of the knife (trailing side) in comparison to the conventional knife holding system, the gibs can no longer provide this wood chip removal and wear resistance function in these embodiments. The illustrated embodiments of FIGS. 2, 3 and 7 desirably feature an elongated axially extending concave surface (several being indicated by the number 110 in these figures) that is provided in the cutter head body extending lengthwise along the leading edge of each blade 62. Desirably, the concave surface 110 extends along the entire length of each blade 62. Although not shown, the surfaces 110 may each be shaped to intersect the adjoining knife blade surface 112 at an angle that is tangential to the knife blade surface to assist in chip removal. To protect the cutter head body from wear, the surfaces 110 may be treated with a wear resistant material. Some exemplary ways of protecting this surface 110 are as follows:

1. Industrial hard chrome plating may be applied to the gullet space surface 110.

2. Carbide, ceramic, or other wear resisting materials may be plasma-sprayed onto the gullet space surface 110.

3. A slot can be machined or otherwise formed into the cutter head body at a location immediately ahead of where the blade is to be located and extending lengthwise, such as along the entire length of the cutter head body. This slot can be sized to accept or receive a replaceable insert of carbide, hardened steel, ceramic or other wear-resistant material. This insert may be braised, structurally bonded, or mechanically fastened to the cutter head body to allow for its replacement if or when it becomes worn. In this case, the surface 110 is formed into the outer exposed surface of the insert. (See insert 114 in FIG. 11).

Each blade 62 is releasably retained within a respective associated blade receiving slot 80. In FIG. 7, there are plural gibs and wedges in each slot.

Figure 4:
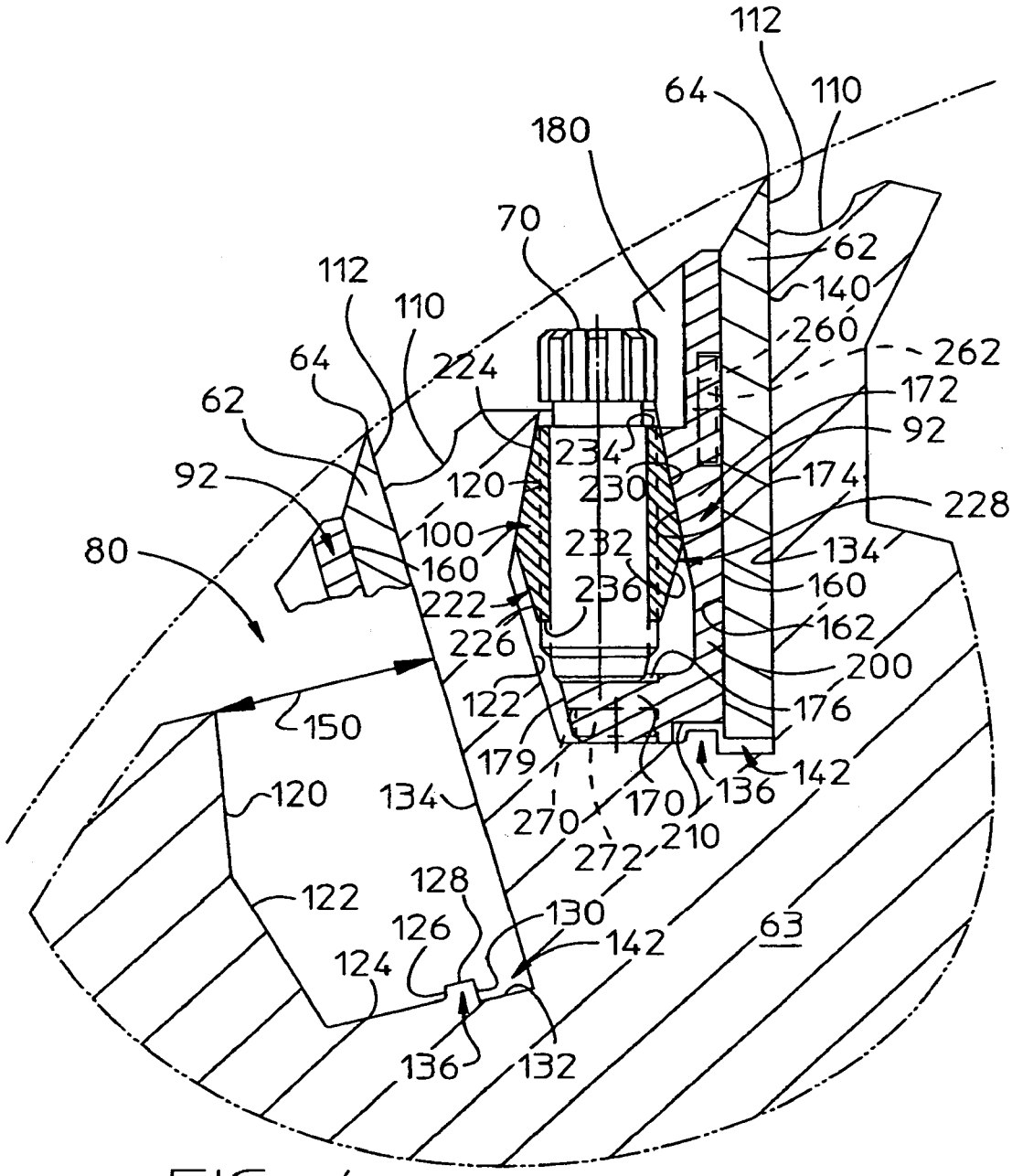
FIG. 4 is a sectional view of a portion of an embodiment of a cutter head for a wood planing machine having an illustrated form of slot, wedge, blade retainer, and blade.

In the embodiments of FIGS. 2, 3 and 7, and as is more clearly shown in FIG. 4, each slot 80 desirably comprises a plurality of walls 120, 122, 124, 126, 128, 130, 132 and 134. The walls 126, 128 and 130 bound an upwardly projecting rib 136 spaced slightly greater than the thickness of the blade 62 away from the wall 134. Consequently, the lower end of the blade may extend below surface 128 and into the space between walls 130 and 134. Thus, desirably, a pocket 142 for receiving the lower end of the blade is formed at this location in the slot. The purpose of optional rib 136 is described below. The leading surface 140 of blade 62 desirably abuts surface 134. The surfaces 130, 132 and lower portion of surface 134 form the pocket 142 into which the lower end of the blade 62 may be inserted so as to permit positioning of the blade 62 deeper into the slot than the adjacent gib supporting wall surface 124 of the slot. The pocket may be deeper than that shown in FIG. 4 if desired. This facilitates the use of wider (bottom edge to tip dimension) blades. The wall surfaces 120 and 122 are positioned along the trailing side wall of the slot 80 in FIG. 4 and are opposite to the wall 134. As can be seen in FIG. 4, in a desirable construction, wall surface 122 diverges from wall surface 134 moving upwardly from the slot base surface 124. In contrast, in this desirable construction, wall surface 120 converges toward wall surface 134 moving upwardly from the upper portion of the wall surface 122. This configuration, which may be varied, provides a narrowed entrance mouth 150 to the slot. The mouth 150 and slot 80 dimensions may be kept consistent for different head sizes and cutting angles to allow interchangeability of wedge members 100 and gibs 92 for various cutting head designs. This still allows for some dimensions, such as the depth of any pocket 142, if provided, to be altered. As a specific example, the width of the mouth may be maintained constant at ¾ inch in some embodiments. Desirably, a minimum thickness of the cutter body (e.g., ¼ inch) is provided between wall 134 of one slot and the adjacent wall 122 of an adjacent slot. This thickness (and hence the spacing between slots) varies with cutting diameters and the number of cutting blades in a particular cutting head. The wall surface 120 is configured to engage a corresponding wedging surface of clamping wedge 100 as explained below to assist in applying the blade retaining clamping forces.

Figure 10:
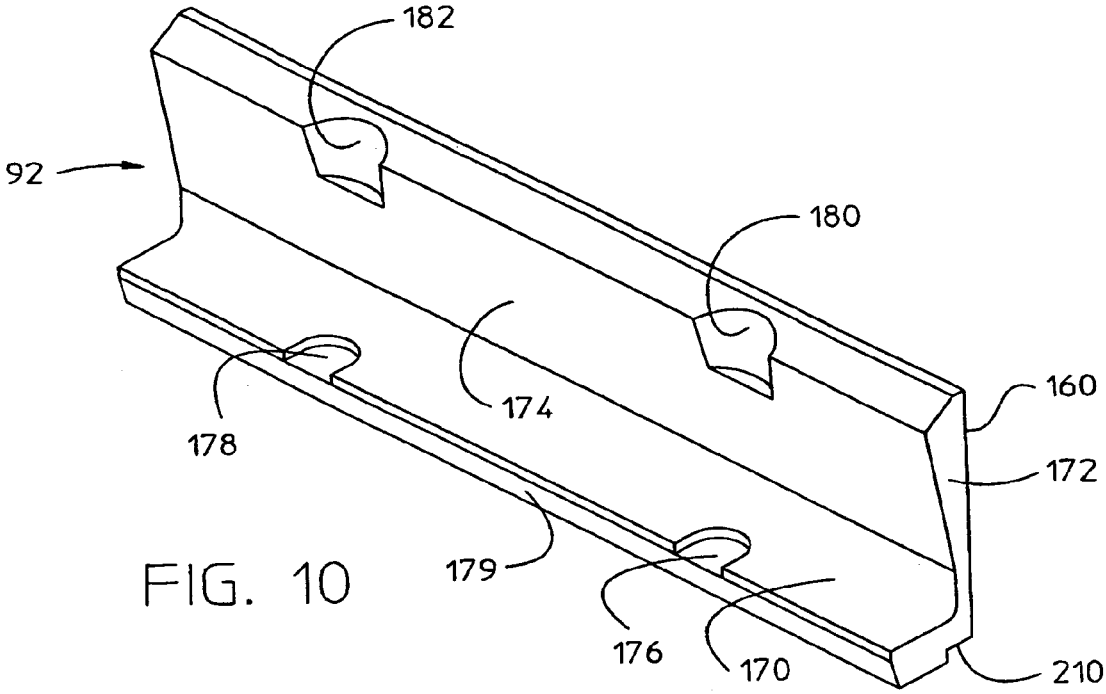
FIG. 10 is an isometric view of a form of blade retainer or gib.

The shape of an exemplary embodiment of the gib 92 that is illustrated in FIG. 4 is desirable, but not required. The gibs 92 are shown in FIGS. 2, 3 and 4 as having an L-shaped cross-section (or equivalently a mirror image L-shape). Reference should also be made to FIG. 10. Each gib 92 (see FIGS. 4 and 10) comprises a blade retention surface 160 that is coupled to and more desirably abuts the trailing side surface 162 of the associated blade 62. Although the gibs and wedges are not required to all be of an identical cross-section, this is desirable. In FIGS. 4 and 10, each illustrated gib 92 comprises a lower enlarged base portion 170 and an upwardly extending leg or wedging portion 172 designed to retain a blade in place. The wedging portion 172 has a trailing side surface 174 that desirably converges toward wall surface 120 moving from base portion 170 in an outward direction toward the slot opening or mouth 150 at the periphery of the body. Surface 174 comprises a form of gib wedging surface. The upper surface of base portion 170 desirably engages and provides support for the lower ends of associated fastener 70 as the fasteners are tightened.

One or more recesses or slots in the upper surface of base 170 of gib 92, such as recesses 176, 178, (best seen in FIG. 10) may be provided to receive the lower ends of the fasteners 70. These recesses provide enough clearance to allow gib 92 to move toward the slot wall 134 as wedge 100 is tightened as explained below. Desirably, recesses 176, 178 extend to the side edge 179 (FIG. 4) adjacent to wall 122 and also open toward the side edge. The recesses receive the lower ends of the fasteners when the fasteners are partially loosened during replacement of the blades or knives so that the fasteners remain in loose engagement with the associated gib and prevent lateral shifting of the associated wedge. Partial bores, such as 180, 182, in surface 174 of the gib leg 172 are desirably provided at the upper end of the gib to provide clearance for the heads of the fasteners and for tools used to tighten such fasteners. Also, this construction allows the upper end of the gib leg 172 to be thicker on either side of the partial bores 180, 182 to provide additional support to the blades during cutting operations. The illustrated form of gib 92 may optionally be thinned or necked down at location 200 in the region where leg portion 172 joins the base portion 170.

A longitudinally extending notch or recess, such as indicated at 210 in FIGS. 4 and 10, is provided inwardly from the lower portion of leg surface 160. Alternatively, such a recess could extend upwardly into the lower surface of the base portion at a location spaced from wall 160. In this embodiment, the lower portion of the base and thus the gib 92 is restricted by rib 136 from shifting across the slot 80 and into abutment with slot wall 134. If magnets are included in gib 92, in an option as explained below, in the absence of a stop, which may take other forms beside the rib and notch configurations shown in these figures, the gib 92 may become magnetically attached to slot wall 134 and be difficult to detach for insertion of a blade.

Figure 9:
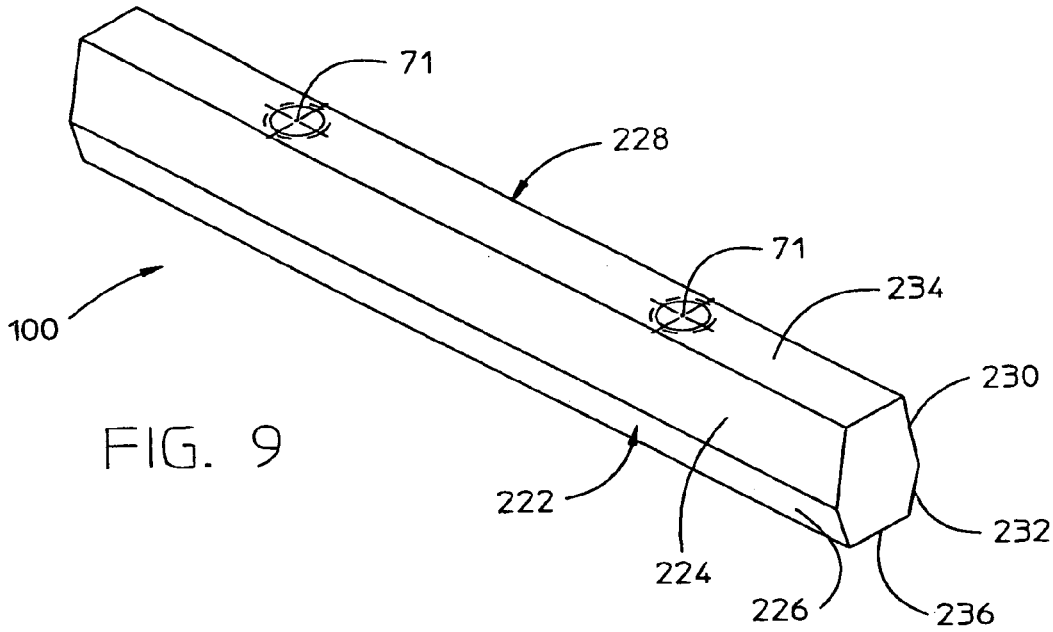
FIG. 9 is an isometric view of a form of wedge.

A respective exemplary wedge member, such as wedge 100, best shown in FIGS. 4 and 9, is inserted into the associated slot 80 between the wedging surface 174 of gib 92 and the wall surfaces 120, 122 of the associated slot 80. Wedge 100, like gib 92, is desirably elongated and may extend along a major portion of, or entirely along, the length of the cutter head. In one specifically illustrated form, three such wedges are provided and together they extend the entire length of the slot. The illustrated wedges are generally hexagonal in cross-section. The exemplary wedge 100 has a first side wall surface 222 with upper and lower surface sections 224,226. The illustrated wedge 100 also comprises a second side wall surface 228 with upper and lower surface sections 230, 232. Wedge 100 also comprises a top surface 234 and a bottom surface 236. Bottom surface 236 is typically spaced from, and may be generally parallel to, the upper surface of base portion 170 of gib 92. In the desirable form shown in FIG. 4, the lowermost portion of wedge 100 is of a reduced cross-sectional dimension so as to be spaced from the respective wall 122 of slot 80 and wall 174 of gib 92. In contrast, the upper portion of the wedge 100 desirably converges, that is upper wall sections 224,230 converge toward one another moving from a central portion of the wedge 100 and toward the top surface 234 thereof. These upper wall sections 224,230 of respective walls 222,228 comprise one form of wedge member wedging surfaces. Desirably, these wedge member wedging surfaces are configured to mate with the respective wedge engagement surfaces of walls 120 and 174 as the wedge 100 is shifted away from the base 170 and toward the opening 150 of slot 80. The upper portions of gib wedge surface 174 and of the slot wedging surface 120 may be configured to match the contour of the upper wedge surfaces 224,230 to enhance the wedging action. For example, these surfaces desirably abut one another (without intervening components although such components could be used) and may be planar and have the same angle.

Figure 5:
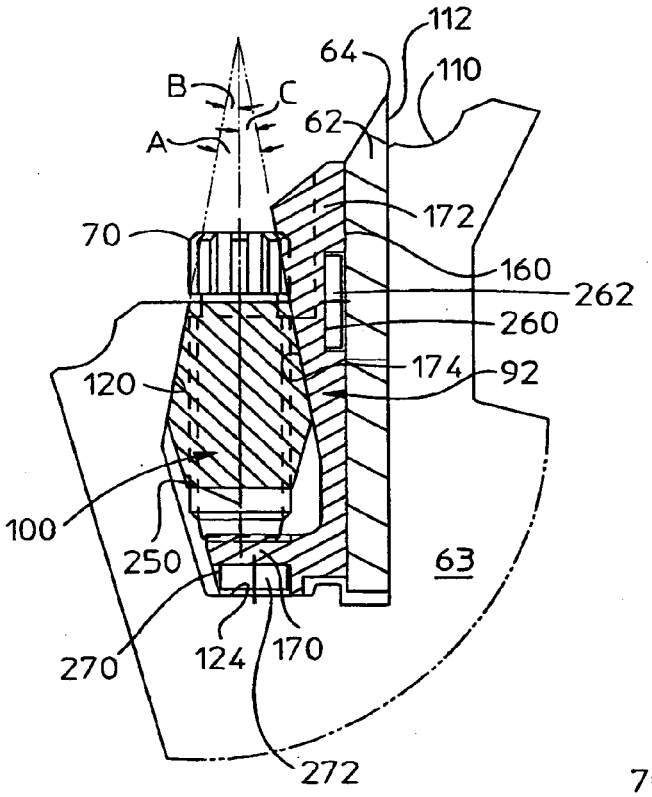
FIG. 5 is a cross-sectional view through a portion of a cutter head of an embodiment taken along a location that exposes first and second magnets of a blade retainer, the wedge of FIG. 5 being shown in a locked position.

The included angle between gib surface 174 and slot wall surface 120 (and thus the angle between the corresponding upper wedge surfaces) is indicated in FIG. 5 as A. In the form shown, the included angle is desirably bisected by the longitudinal axis 250 of the fastener 70. The angle B is the angle between axis 250 and the slot wall surface 120 and the angle C is the angle between axis 250 and gib wall surface 174. Thus, in the form shown, although not required, B is equal to C. Desirably, the angle A is greater than or equal to 20 degrees and a desirable range for angle A is from about 20 to 30 degrees. The term about allows for some deviation from these specified values, such as a 10 percent deviation. As the angle increases, the number of slots and knife blades that can be positioned about a cutter head of a given diameter is decreased.

At an angle A of 20 degrees and higher, the wedge tends to be self-releasing in that the wedge will loosen from the gib as the fastener is loosened. As the angle A decreases below 20 degrees, the wedge 100 tends to become stuck and remain wedged in place even as the fastener is loosened. In this case, the wedge can be difficult to free (e.g., by tapping or hitting it). Thus, although the included angle A can be less than 20 degrees, this is less desirable.

The side edge 179 (FIG. 4) of gib base 170 is desirably spaced from the adjoining slot wall section 122 to provide clearance which allows the gib 92 to shift toward wall 122 when the blade is being inserted.

The wedge 100 shown in FIGS. 7 and 9 has two spaced apart threaded fastener receiving bores 71 for receiving respective threaded screws or fasteners 70.

Figure 6:
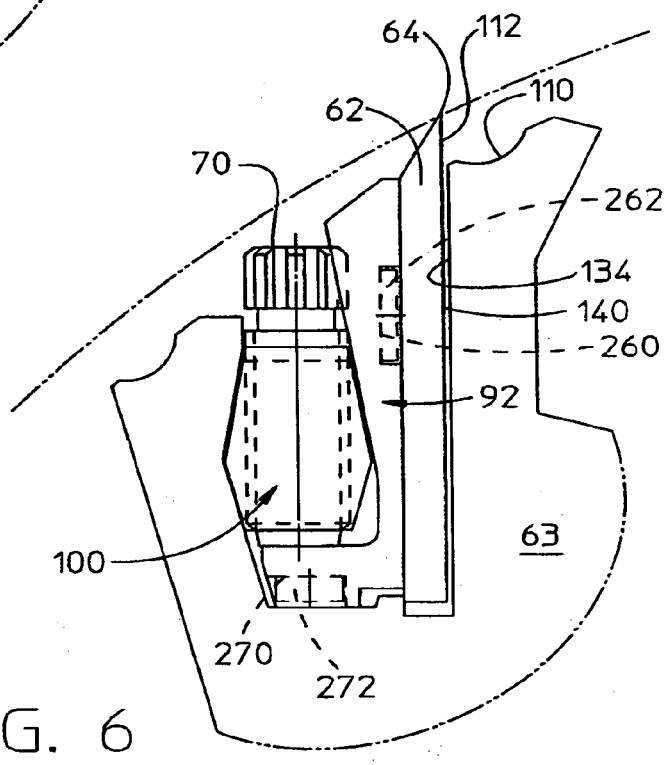
FIG. 6 is a cross-sectional view, similar to FIG. 5, with the wedge being shown in an unlocked position to facilitate removal of a blade.

In operation, with the blade retaining assembly 60 placed in slot 80, the associated fasteners 70 may be rotated in a first direction. As these fasteners are rotated, the upper surface of base portion 170 supports the lower end of the fasteners. Consequently, the wedge 100 shifts in the slot 80 toward the slot opening 150. As a result, the surfaces 224 and 230 bear respectively tighter against the slot wall 120 and gib wedging surface 174. The wedge 100 in FIG. 6 is shown loosened with a gap between blade surface 140 and slot surface 134. When in this condition, the blade can be removed from the slot 80. The clamping mechanisms may be partially tightened with blade positions then being adjusted to their desired radius before fully tightening the clamping assemblies. As the wedge 100 is shifted toward wedging position, the fasteners 70 urge the leg member 172 into tighter engagement against the side surface 162 of the blade.

Thus, the embodiment of FIG. 4 has an up-locking configuration. That is, the wedge member 100 is moved outwardly toward the opening 150 of the slot to accomplish locking. The fasteners 70 urge the wedge member outwardly as they are tightened. This construction provides enhanced holding force against the respective blades with fewer fasteners being required to achieve the same holding force in comparison to certain other designs. This configuration of a clamping assembly also allows for closer spacing of the knife blades, if desired, to permit a greater number of knives for a cutter head of a given cutting blade tip diameter.

The fasteners in the FIG. 4 embodiment urge the wedge 100 upwardly at the same time as the gib 92 is urged downwardly. This assists in maintaining the knife stationary during the tightening process. The wedge bears against inclined surfaces built in to both the cutter head slot and gib in this embodiment. In addition, the illustrated form of gib is necked down (see thinned or necked region 200 of gib 92 in FIG. 4) below the gib wedging surface 174 and above the upper surface of the base 170 of the gib against which the fasteners make contact. This allows some flexing at this necked location of the gib as the fasteners are tightened, if, for example, the gib leg is not in precise alignment with the blade. This may provide a greater holding force at the upper section of the gib against the blade.

In the configuration of FIG. 4, mechanisms may be included for assisting and adjusting the cutter blade height, or in retaining the assembly 60 in place during blade replacement, such as, but not limited to, magnets.

The height of the blades may be adjusted in the same manner as has been done in the past, or in any other suitable manner. However, FIGS. 4 and 5 illustrate desirable embodiments with optional mechanisms for holding the blades in position to facilitate adjustment of the height of the blades when the blades are replaced.

In the embodiments of FIGS. 4 and 5, the upwardly extending leg portion 172 of gib 92 is provided with an inwardly extended recess indicated at 260. Recess 260 may be circular in configuration and extends inwardly from gib surface 160 and thus is positioned adjacent to the surface 162 of blade 62. A plurality of these recesses may be provided at spaced apart locations along the length of the gib. For example, two recesses are desirably provided for a 7.5 inch long gib and one centrally positioned recess is desirably provided for a 5 inch long gib. A magnet may be positioned in each of these recesses, such as magnet 262 in recess 260. Desirably, the magnet is positioned with an exposed surface that is flush with or recessed below the surface 160 of the gib. Consequently, the magnet will not interfere with the knife positioning. As another example, four such magnets may be used. Exemplary magnets are rare earth disk magnets (for example sintered Neodymium Iron Boron magnets). These magnets retain the blade against the gib, yet allow the height of the blade to be adjusted by permitting sliding of the blade relative to the gib and relative to the magnets.

The embodiment of FIGS. 4 and 5 also optionally uses magnets to hold the assembly 60 in place as the blades are being replaced. This prevents the gibs 92 and wedges 100 from falling out of their associated slots 80 when the blades are removed. It is common practice for an operator to remove all of the old blades from a cutter head prior to replacing them with new blades. As the cutter head is rotated following the removal of the blades, the gibs and wedges could fall free from the slots due to gravity in the absence of some mechanism to prevent this. Other mechanisms may also be used. However, one or more (such as two) recesses 270 (FIG. 5) may be provided in the undersurface of the base 170 adjacent to slot wall 124. These recesses may be circular or of any other suitable shape. A magnet 272, which may be like magnet 262, is positioned in each recess. The magnet is desirably positioned flush with or above the lower surface of base portion 170 so that the magnet 272 does not interfere with the engagement of the gib with slot surface 124 when the fasteners are tightened. The recesses 270 and magnets 272 are also shown in FIG. 7.

Desirably, in one form, the slot 80, wedge 100 and gib 92 are sized and configured such that one cannot place a gib and wedge into a slot if the blade 62 is already present in the slot. That is, in this form, the wedge and gib are first placed in the slot and positioned at a location sufficiently below the narrowed mouth 150 to permit insertion of the blade 62. With this configuration, the slot itself assists in retaining the clamping assembly on the cutter head (by centrifugal force when the cutter head is rotating) rather than relying, for example, solely on the strength of fasteners.

The construction of FIGS. 2, 3, 4 and 7, as well as other constructions utilizing such a wedge or retainer clamping mechanism, may be incorporated into cutter heads for newly built planers, or into retrofit cutter heads for existing planers, or used to retrofit existing cutter heads. The embodiments may have components in addition to those illustrated above, for example, intervening components between the clamping surfaces, although this is less desirable.

Figure 12:
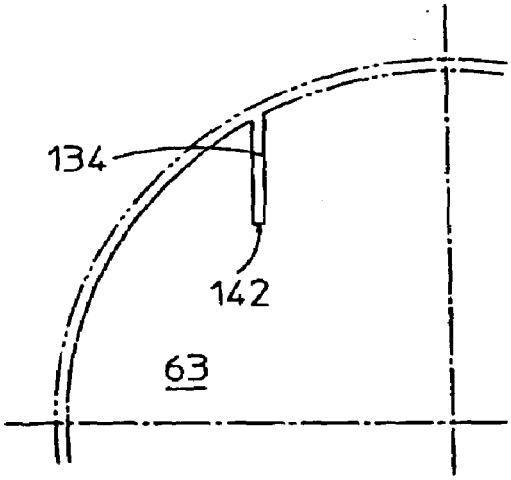
FIGS. 12–14 schematically illustrate exemplary steps that may be followed in forming blade receiving slots in a cutter head body.
Figure 13:
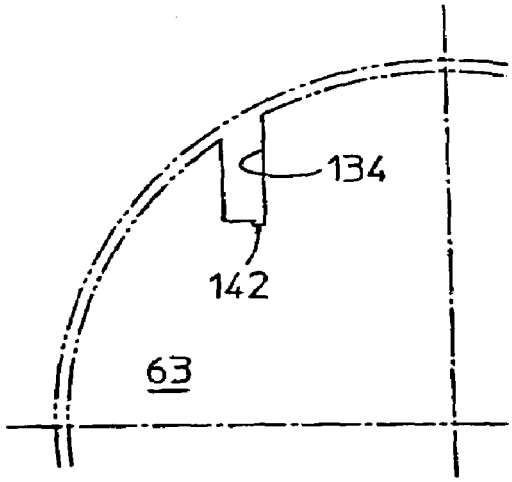
Figure 14:
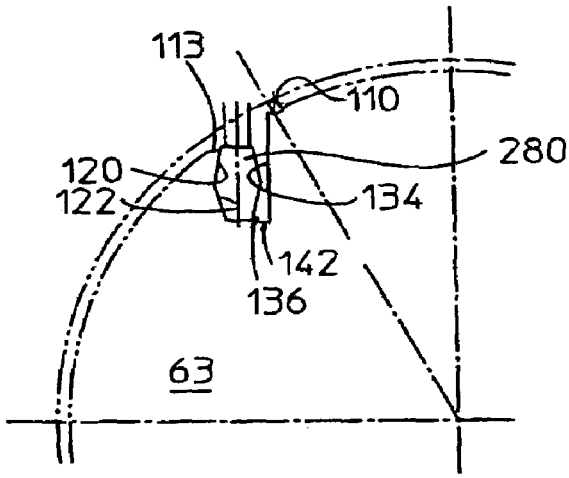

With reference to FIGS. 12, 13 and 14, one approach for producing a cutter head having slot configuration in a desirable form will next be described. Referring to FIG. 12, a narrow slot is cut into a cylindrical cutter head body to form the wall surface 134 and pocket 142. Wall surface 134 is angled at a desirable angle in this embodiment for supporting a cutter head blade at an appropriate cutting angle for the specific cutter head body being made. In FIG. 13, a wider slot is cut to form a side wall spaced from wall 134 and a shelf surface positioned above the deepest level of pocket 142. Referring to FIG. 14, following the removal of material at area 113 to define the slot mouth between area 113 and wall 134, a rotary machining head 280 of an appropriate shape is used to cut the surfaces 120, 122 and into the base of the slot to form the base surface 124 of the slot and the rib 136 conventional tools exist for indexing a cutter head to the location for cutting the next slot with the appropriate spacing between slots. The cutter head bodies may be formed in any suitable manner and this particular order of steps is not required if a machining operation is used.

In addition to the various embodiments described above, unique and non-obvious methods of installing and securing cutter head blades in place will be apparent from these embodiments. Having illustrated and described the principles of my invention with reference to several embodiments, it should be apparent to those of ordinary skill in the art that these embodiments may be modified in arrangement and detail without departing from the principles of my invention. I claim all such variations.

I claim:

1. A wood planing apparatus comprising:

an elongated cutter head body rotatable about an axis of rotation, the cutter head body including an exterior surface and comprising plural elongated blade retaining slots extending in a lengthwise direction along the cutter head body, each slot comprising a first wall surface extending inwardly into the cutter head body from the exterior surface of the cutter head body, a slot base surface spaced from the exterior surface, and a second wall surface spaced from the first wall surface, the cutter head body comprising a wedge retaining portion including a slot wedging surface that comprises a portion of the second wall surface and that at least partially overhangs the slot base surface;

a plurality of blade retainers, each blade retainer comprising a base portion positioned adjacent to the slot base surface of a respective associated slot into which the blade retainer is inserted, each blade retainer also comprising a blade retention portion extending upwardly from the base portion, the blade retention portion comprising a blade retention surface positioned adjacent to and spaced from the first wall surface of the associated slot, the blade retention portion further comprising a retention member wedging surface that at least partially overhangs the slot base surface of the associated slot;

a plurality of wedges, each wedge comprising a first wedging surface portion positioned for selective coupling to the slot wedging surface of a respective associated slot, each wedge overlying the base portion of an associated blade retainer, each wedge further comprising a second wedging surface portion positioned for selective coupling to the retention member wedging surface of the associated blade retainer;

a plurality of elongated blades, at least one of the blades being placed in each slot between the first wall surface of the slot and the blade retention surface of a blade retainer inserted into the slot with the slot and blade retainer thereby being associated;

wherein each wedge comprises at least one threaded wedge aperture extending through the wedge and toward the base portion of the associated blade retainer, a threaded member threadedly received within the wedge aperture such that rotation of the threaded member in one direction urges the first wedging surface portion of the wedge toward the slot wedging surface of the associated slot and the second wedging surface portion of the wedge toward the retention member wedging surface of the associated blade retainer and to a locking position at which the blade retention surface of the associated blade retainer applies a clamping force to the associated blade positioned in the associated slot, and wherein rotation of the threaded member in a second direction opposite to said one direction relieves the applied clamping force so as to permit removal of the blade from the associated slot; and wherein the cutter head is rotated in a first direction and wherein each blade leads the associated wedge and associated blade retainer that applies the clamping force to the blade in the direction of rotation of the cutter head.

2. A wood planing apparatus according to claim 1 wherein each slot further comprises a blade receiving pocket defined in part by the slot base surface and positioned adjacent to the first wall surface, each slot also comprising a stop projecting from the slot base surface at a location adjacent to the blade receiving pocket, the base portion of each blade retainer comprising a stop engaging portion positioned to engage the stop of the associated slot to limit the extent of movement of the blade retainer toward the first wall surface of the associated slot.

3. A wood planing apparatus according to claim 1 wherein each wedge is hexagonal in cross-section and each blade retainer is L-shaped in cross-section.

4. A wood planing apparatus according to claim 1 wherein the first and second wedging surface portions of each wedge define an included angle that is from about 20 to 30 degrees and wherein each slot wedging surface is at an angle that matches the angle of the first wedging surface of the associated wedge, and wherein the retention member wedging surface of the associated blade retainer is at an angle that matches the angle of the second wedging surface portion of the associated wedge.

5. A wood planing apparatus according to claim 4 further comprising an elongated insert that is recessed into the surface of the cutter head body at a location that leads the blade in the direction of rotation of the cutter head body, the insert having an elongated arcuate wood chip deflecting surface adjacent to the leading edge of the blade.

6. A wood planing apparatus according to claim 1 wherein each blade retainer comprises at least one first magnet positioned in the base portion and oriented to provide a magnetic attraction force toward the slot base surface when the blade retainer is positioned within the associated slot to thereby assist in retaining the blade retainer within the associated slot, and wherein each blade retainer further comprises at least one second magnet in the blade retention portion thereof and oriented to provide a magnetic attraction force toward the first wall surface of the associated slot and thus toward a blade inserted between the blade retention surface and the first wall surface of the associated slot.

7. A wood planing apparatus according to claim 1 wherein the slots extend lengthwise at least along substantially the entire length of the cutter head body, the cutter head body having a longitudinal axis and the slots being parallel to the longitudinal axis of the cutter head body, there being at least twenty-four of such slots in a cutter head having the blades set at a diameter of 12.25 inches.

8. A wood planing apparatus according to claim 1 wherein there are plural elongated wedges, plural elongated blade retainers and plural elongated blades positioned within each slot.

9. A wood planing apparatus comprising:

an elongated cutter head body rotatable about an axis of rotation, the cutter head body comprising at least one elongated blade retaining slot extending at least partially along the length of the cutter head body, the slot comprising a first wall surface extending into the cutter head body, a slot base surface and a second wall surface spaced from the first wall surface, the slot base surface extending from the first wall surface to the second wall surface, the second wall surface comprising a slot wedging surface portion spaced from the slot base surface and extending at least in part toward the first wall surface such that the cutter body comprises a wedge retaining lip portion of the slot wedging surface portion;

at least one elongated blade retaining member comprising a base portion and a blade retention portion extending from a first location of the base portion, the base portion including a first base surface positioned adjacent to the slot base surface, the blade retention portion including a blade retention surface positioned adjacent to and spaced from the first wall surface such that an elongated cutter blade may be positioned between the blade retention surface and first wall surface, the blade retention portion further comprising a retention member wedging surface portion that converges at least in part toward the slot wedging surface portion;

at least one elongated wedge comprising a first wedging surface portion positioned adjacent to the slot wedging surface portion, the wedge also comprising a second wedging surface portion positioned adjacent to the retention member wedging surface portion, the first and second wedging surface portions at least in part converging toward one another; and a selective force applicator coupled to the wedge and being operable to selectively apply a locking force to the wedge to urge the first wedging surface portion toward the slot wedging surface portion and the second wedging surface portion toward the retention member wedging surface portion to thereby urge the blade retention portion toward a blade positioned between the blade retention surface and the first wall surface and to a locking position at which the blade is locked between the blade retention surface and first wall surface, the selective force applicator also being operable to selectively release the locking force applied to the wedge to permit the removal of the blade.

10. A wood planing apparatus according to claim 9 wherein the cutter head body is rotated in a first direction and wherein the first wall surface leads both the retaining member and wedge in the direction of rotation of the cutter head.

11. A wood planing apparatus according to claim 9 wherein the wedge comprises first and second threaded wedge apertures extending through the wedge member and toward the slot base surface when the wedge member is inserted into the slot, the selective force applicator comprising respective threaded members threadedly received within the respective wedge apertures such that rotation of the threaded members either selectively applies or releases the locking force depending upon the direction of rotation of the threaded members, the threaded members applying a force against the base portion of the blade retention member that increases as the first and second wedging surface portions are urged toward the slot wedging surface portion and retention member wedging surface portion.

12. A wood planing apparatus according to claim 9 wherein the slot further comprises a blade receiving pocket in the slot base surface and adjacent to the first wall surface, the slot also comprising a stop projecting from the slot base surface adjacent to the blade receiving pocket, the base portion of the blade retaining member comprising a stop engaging portion positioned to engage the stop to limit the extent of movement of the blade retaining member toward the first wall surface.

13. A wood planing apparatus according to claim 12 wherein the stop comprises an elongated rib projecting upwardly from the slot base surface and spaced from the slot backup wall surface.

14. A wood planing apparatus according to claim 12 wherein the slot base surface comprises a shelf portion positioned to engage the first surface of the base portion of the blade retaining member, the shelf portion being positioned at a depth from the surface of the cutter head body that is shallower than the depth of the pocket, wherein the blade retaining member comprises at least one stop receiving recess that opens toward the blade retention surface such that the stop slides into the stop receiving recess as the base portion of the blade retaining member is shifted toward the first wall surface, and wherein the stop engages the base portion to limit the motion of the blade retaining member toward the first wall surface.

15. A wood planing apparatus according to claim 9 wherein the slot wedging surface portion and retention member wedging surface portion include converging surface portions with a included angle therebetween of from about 20 to 30 degrees and wherein the first and second wedging surface portions also have a corresponding included angle of from about 20 to 30 degrees.

16. A wood planing apparatus according to claim 11 wherein the slot wedging surface portion and retention member wedging surface portion include converging surface portions with a included angle therebetween of from about 20 to 30 degrees and wherein the first and second wedging surface portions also have a corresponding included angle of from about 20 to 30 degrees, and wherein the threaded members have longitudinal axes positioned in a plane that bisects the included angle.

17. A wood planing apparatus according to claim 15 wherein the first and second wedging surface portions, slot wedging surface portion, and the retention member wedging surface portion each are planar and directly engage and contact one another upon urging of the first wedging surface portion toward the slot wedging surface portion and the second wedging surface toward the retention member wedging surface portion when the blade retention portion is in the locking position.

18. A wood planing apparatus according to claim 9 comprising at least one first magnet in the base portion oriented to provide a magnetic attraction force toward the slot base surface when the blade retaining member is positioned within the slot to thereby assist in retaining the blade retaining member within the slot.

19. A wood planing apparatus according to claim 18 wherein the blade retaining member further comprises a region of reduced thickness adjacent to the first location of the base portion.

20. A wood planing apparatus according to claim 18 wherein the blade retaining member further comprises at least one second magnet in the blade retention portion oriented to provide a magnetic attraction force toward the first wall surface of the slot and thus toward a blade inserted between the blade retention surface and the first wall surface.

21. A wood planing apparatus according to claim 20 wherein the base portion of the blade retaining member comprises a second base surface spaced from the first base surface, the base portion of the blade retaining member further comprising an end edge surface converging at least in part toward the blade retention wall surface moving in a direction from the second base surface and toward the first base surface, the wood planing apparatus further comprising selective force applicators in the form of spaced apart threaded members received within threaded openings extending through the wedges, the threaded members including end portions positioned to engage the second surface of the base portion such that the threaded members may be rotated to urge the wedge away from the base portion and toward the slot wedging surface portion and retention member wedging surface portion, the end portions of the threaded members being received in respective spaced apart recesses of the second base surface, and wherein the recesses of the second base surface extend to the end edge surface.

22. A wood planing apparatus according to claim 9 wherein the wedge member comprises a wedge body having first and second longitudinally extending first and second wedging surface portions that converge at least in part toward one another moving in a first direction from a central portion of the wedge body, the wedge body also comprising third and fourth longitudinally extending wedge surface portions that converge at least in part toward one another moving in a second direction opposite to the first direction and from the central portion of the wedge body.

23. A wood planing apparatus according to claim 22 wherein the first and second wedging surface portions are planar with an included angle between the first and second wedging surface portions being from 20 to 30 degrees.

24. A wood planing apparatus according to claim 23 wherein the wedge body is hexagonal in cross-section with a respective fifth surface extending between the first and second wedging surface portions and a respective sixth surface extending between the third and fourth wedging surface portions, the apparatus further comprising plural spaced apart threaded openings extending through the wedge body from the fifth surface to the sixth surface, and wherein the selective force applicator comprises threaded members each positioned within a respective threaded aperture.

25. A wood planing apparatus comprising:

an elongated cutter head body rotatable about an axis of rotation, the cutter head body comprising plural elongated blade retaining slots extending in a lengthwise direction along the cutter head body, each slot comprising a first wall surface extending inwardly into the cutter head body from a surface of the cutter head body, a slot base surface at the base of the slot and a wedge retaining portion including a slot wedging surface portion overhanging the slot base surface and being spaced from the first slot wall surface;

a plurality of elongated blade retaining members, at least one of said blade retaining members being associated with each slot for positioning within the associated slot, each blade retaining member comprising a base portion positioned adjacent to the slot base surface of the associated slot and a blade retention portion extending upwardly from the base portion, the blade retention portion comprising a blade retention surface positioned adjacent to and spaced from the first wall surface of the associated slot such that an elongated cutter blade may be positioned in the associated slot between the blade retention surface and first wall surface, the blade retention portion further comprising a retention member wedging surface portion that extends toward and is spaced from the slot wedging surface portion;

a plurality of elongated wedges, at least one of said wedges being associated with each slot and with each retainer member, each wedge member comprising respective first and second wedging surface portions for respectively and selectively engaging the wedging surface portion of the associated slot and the retention member wedging surface portion of the associated retaining member;

a plurality of elongated blades, at least one of said blades being associated with each slot and positioned in the associated slot for selective clamping in the associated slot by the associated wedge and associated blade retaining member;

wherein each wedge member comprises first and second threaded wedge apertures extending through the wedge member and toward the retaining member base portion when the wedge and associated blade retaining member are inserted into the associated slot, respective threaded members each threadedly received within a respective wedge aperture, the threaded members applying a force against the base portion of the blade retention member that increases as the first and second wedging surface portions are urged by threading of the threaded members into the apertures to urge the first and second wedging surface portions of the wedge against the slot wedging surface portion of the associated slot and the retention member wedging surface portion of the associated blade retainer member;

wherein the cutter head is rotated in a first direction and wherein each first wall surface leads the associated wedge in the direction of rotation of the cutter head;

the slot further comprising a blade receiving pocket in the slot base surface and adjacent to the first wall surface, the slot also comprising a stop projecting from the slot base surface adjacent to the blade receiving pocket, the base surface of the blade retaining member comprising a stop engaging portion positioned to engage the stop to limit the extent of movement of the blade retaining member toward the first wall surface of the associated slot;

wherein the slot wedging surface portion and associated retention member wedging surface portion include converging surface portions with an included angle therebetween of from about 20 to 30 degrees and wherein the first and second wedging surface portions also have a corresponding included angle of from about 20 to 30 degrees, and wherein the threaded members have longitudinal axes positioned in a plane that bisects the included angle;

at least one first magnet in the base portion oriented to provide a magnetic attraction force toward the slot base surface of the associated slot when the blade retaining member is positioned within the associated slot to thereby assist in retaining the blade retaining member within the associated slot;

the blade retaining member further comprising a region of reduced thickness adjacent to the first location of the base portion;

the blade retaining member also comprising at least one second magnet in the blade retention portion oriented to provide a magnetic attraction force toward the first wall surface of the associated slot and thus toward a blade inserted between the blade retention surface and the first wall surface;

wherein the base portion of the blade retaining member comprises a second base surface spaced from the first base surface, the threaded members including end portions positioned to engage the second surface of the base portion such that the threaded members may be rotated to urge the wedge away from the associated base portion, toward the slot wedging surface portion of the associated slot and toward the retention member wedging surface portion of the associated blade retaining member, the end portions of the threaded members being received in respective spaced apart recesses of the second base surface;

wherein the wedge comprises a wedge body having first and second longitudinally extending first and second wedging surface portions that converge toward one another moving in a first direction from a central portion of the wedge body, and the wedge body also comprising third and fourth wedge surface portions that converge toward one another moving in a second direction opposite to the first direction and from the central portion of the wedge body.

* * * * *